US009243530B2

(12) United States Patent
Irisawa

(10) Patent No.: US 9,243,530 B2
(45) Date of Patent: Jan. 26, 2016

(54) FUEL INJECTION SYSTEM FOR INTERNAL COMBUSTION ENGINE

(75) Inventor: Yasuyuki Irisawa, Susono (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 0 days.

(21) Appl. No.: 14/361,734

(22) PCT Filed: Dec. 2, 2011

(86) PCT No.: PCT/JP2011/077936
§ 371 (c)(1),
(2), (4) Date: May 30, 2014

(87) PCT Pub. No.: WO2013/080371
PCT Pub. Date: Jun. 6, 2013

(65) Prior Publication Data

US 2014/0331653 A1 Nov. 13, 2014

(51) Int. Cl.

| | |
|---|---|
| ***F01N 3/00*** | (2006.01) |
| ***F01N 3/021*** | (2006.01) |
| ***F02D 41/02*** | (2006.01) |
| ***F02D 41/30*** | (2006.01) |

(52) U.S. Cl.
CPC ..... *F01N 3/021* (2013.01); *F02D 41/029* (2013.01); *F02D 41/3023* (2013.01); *F02D 41/3094* (2013.01); *F02D 2200/0812* (2013.01); *F02D 2250/38* (2013.01)

(58) Field of Classification Search
USPC ..... 60/274, 285, 286, 295, 297, 301, 303
See application file for complete search history.

(56) References Cited

U.S. PATENT DOCUMENTS

| | | | | |
|---|---|---|---|---|
| 4,034,733 | A * | 7/1977 | Noguchi et al. | 123/268 |
| 5,343,702 | A * | 9/1994 | Miyajima et al. | 60/285 |
| 7,412,821 | B2 * | 8/2008 | Araki et al. | 60/284 |
| 7,966,810 | B2 * | 6/2011 | Ito et al. | 60/285 |
| 8,100,107 | B2 * | 1/2012 | Bidner et al. | 123/299 |
| 8,434,450 | B2 * | 5/2013 | Durrett | 123/299 |
| 2006/0096572 | A1 | 5/2006 | Satou et al. | |
| 2006/0137327 | A1 | 6/2006 | Shirakawa et al. | |

FOREIGN PATENT DOCUMENTS

| | | | |
|---|---|---|---|
| JP | 2004-278356 | A | 10/2004 |
| JP | 2006-138252 | A | 6/2006 |
| JP | 2006-183599 | A | 7/2006 |
| JP | 2010-222978 | A | 10/2010 |
| JP | 2011-241703 | A | 12/2011 |

* cited by examiner

*Primary Examiner* — Binh Q Tran
(74) *Attorney, Agent, or Firm* — Kenyon & Kenyon LLP

(57) ABSTRACT

An object of the invention is to provide a fuel injection technique suitable for a spark-ignition internal combustion engine equipped with a first fuel injection valve for injecting fuel into a cylinder, a second fuel injection valve for injecting fuel into an intake passage, and a particulate filter provided in an exhaust passage thereof. To achieve the object, the fuel injection system of an internal combustion engine according to the invention reduces an in-cylinder injection ratio, which is the ratio of the quantity of fuel injected through the first fuel injection valve to the quantity of fuel injected through the second fuel injection valve, when the quantity of particulate matter trapped in the particulate filter is larger than a threshold value, thereby reducing the quantity of particulate matter discharged from the internal combustion engine.

8 Claims, 3 Drawing Sheets

FUEL INJECTION SYSTEM FOR INTERNAL COMBUSTION ENGINE

CROSS-REFERENCE TO RELATED APPLICATIONS

This is a national phase application based on the PCT International Patent Application No. PCT/JP2011/077936 filed Dec. 2, 2011, the entire contents of which are incorporated herein by reference.

TECHNICAL FIELD

The present invention relates to a fuel injection technology for a spark-ignition internal combustion engine equipped with a first fuel injection valve for injecting fuel into a cylinder, a second fuel injection valve for injecting fuel into an intake passage, and a particulate filter provided in an exhaust passage.

BACKGROUND ART

In a known technology pertaining to an internal combustion engine equipped with a first fuel injection valve for injecting fuel into a cylinder and a second fuel injection valve for injecting fuel into an intake passage, the proportion of injection through the first fuel injection valve is increased with a shift into a predetermined high engine speed range (see, for example, patent document 1).

In another known technology pertaining to a compression-ignition internal combustion engine equipped with an EGR (Exhaust Gas Recirculation) system, the quantity of the EGR gas is adjusted in such a way as to reduce the amount of soot emitted from the internal combustion engine while a processing for resolving sulfur poisoning (SOx poisoning) of an NOx catalyst provided in an exhaust passage (see, for example, patent document 2) is performed.

PRIOR ART DOCUMENTS

Patent Documents

Patent Document 1: Japanese Patent Application Laid-Open No. 2006-138252

Patent Document 1: Japanese Patent Application Laid-Open No. 2004-278356

DISCLOSURE OF THE INVENTION

Problem to be Solved by the Invention

An object of the present invention is to provide a fuel injection technique suitable for a spark-ignition internal combustion engine equipped with a first fuel injection valve for injecting fuel into a cylinder, a second fuel injection valve for injecting fuel into an intake passage, and a particulate filter provided in an exhaust passage thereof.

Means for Solving the Problem

To solve the above-described problem, the present invention provides a fuel injection system of an internal combustion engine equipped with a first fuel injection valve that injects fuel into a cylinder, a second fuel injection valve that injects fuel into an intake passage, and a particulate filter provided in an exhaust passage, in which the injection ratio of the first fuel injection valve and the second fuel injection valve is adjusted so as to reduce the amount of particulate matter discharged from the internal combustion engine, when the amount of particulate matter (PM) trapped in the particulate filter is larger than a threshold value.

Specifically, the fuel injection system of an internal combustion engine according to the present invention comprises:

a first fuel injection valve that injects fuel into a cylinder;

a second fuel injection valve that injects fuel into an intake passage;

a particulate filter provided in an exhaust passage to trap particulate matter contained in exhaust gas;

control means that makes an in-cylinder injection ratio smaller when the quantity of particulate matter trapped in the particulate filter is equal to or larger than a threshold value than when it is smaller than the threshold value, the in-cylinder injection ratio being the ratio of the quantity of fuel injected through the first fuel injection valve to the total quantity of fuel injected through the first fuel injection valve and the second fuel injection valve.

The "threshold value" mentioned above may be, for example, a value equal to an amount of trapped particulate matter (PM) that is considered to require processing for removing the particulate matter trapped in the particulate filter (filter regeneration processing) or a value equal to this amount of trapped particulate matter minus a margin.

The pressure loss of the exhaust gas through the particulate filter is larger when the amount of PM trapped in the particulate filter is large than when it is small. Therefore, the back pressure acting on the internal combustion engine is higher when the amount of PM trapped in the particulate filter is large than when it is small. An excessively high back pressure may lead to a decrease in the power output of the internal combustion engine and/or an increase in the fuel consumption. Therefore, it is necessary to remove PM from the particulate filter before the back pressure becomes so high as to lead to a decrease in the power output of the internal combustion engine and/or an increase in the fuel consumption.

One method of removing PM from the particulate filter is to expose the particulate filter to a high temperature atmosphere containing excessive oxygen when the trapped PM amount reaches a predetermined amount (threshold value), thereby oxidizing PM. To create a high temperature atmosphere containing excessive oxygen in a spark-ignition internal combustion engine, it is necessary to cause the internal combustion engine to operate at a lean air-fuel ratio or in fuel-cut operation to raise the temperature of the exhaust gas. However, there may be cases in which an operation state that is not suitable for the filter regeneration processing continues by some driving operation that the driver takes. In such cases, there is a possibility that the amount of PM trapped in the particulate filter may become excessively large to lead to problems such as a decrease in the power output of the internal combustion engine and/or an increase in the fuel consumption.

In the fuel injection system of an internal combustion engine according to the present invention, the in-cylinder injection ratio is made smaller when the amount of PM trapped in the particulate filter is equal to or larger than the threshold value than when it is smaller than the threshold value. The quantity of PM discharged from the internal combustion engine tends to be larger when the in-cylinder injection ratio is high than when it is low. Therefore, if the in-cylinder injection ratio is decreased when the amount of PM trapped in the particulate filter is larger than the threshold value, the quantity of PM discharged from the internal combustion engine decreases. Consequently, the quantity of PM trapped by the particulate filter per unit time or the increase in the trapped PM amount per unit time (increase rate) can be made smaller.

Therefore, an excessive increase in the trapped PM amount can be prevented even if an operation state that is not suitable for the filter regeneration processing continues after the trapped PM amount reaches the threshold value. Consequently, an excessive increase in the back pressure can be prevented, and it is possible to prevent a decrease in the power output of the internal combustion engine and an increase in the fuel consumption as much as possible.

In an internal combustion engine having a first fuel injection valve and a second fuel injection valve, there may be cases in which fuel is injected only through the first fuel injection valve in some operation state of the internal combustion engine. If the trapped PM amount becomes equal to or larger than the threshold value in such cases, the control means may decrease the fuel injection quantity through the first fuel injection valve and inject fuel through the second fuel injection valve by a quantity equal to the decrease in the fuel injection quantity through the first fuel injection valve.

In the fuel injection system of an internal combustion engine according to the present invention, the control means may make the in-cylinder injection ratio equal to zero when the amount of PM trapped in the particulate filter reaches an upper limit value larger than the aforementioned threshold value. In other words, when the amount of trapped PM is equal to or larger than the upper limit value, the control means may cause the first fuel injection valve to stop to operate and cause only the second fuel injection valve to inject fuel.

The "upper limit value" mentioned above is equal to an amount of trapped PM that is considered to cause excessive temperature rise of the particulate filter when the filter regeneration processing is performed (this amount will be hereinafter referred to as the "OT limit amount") minus a margin.

After the amount of PM trapped in the particulate filter reaches the threshold value, the quantity of PM trapped by the particulate filter per unit time decreases with the decrease in the in-cylinder injection ratio. However, if an operation state not suitable for the filter regeneration processing continues a long period of time after the amount of trapped P reaches the threshold value, there is a possibility that the amount of trapped PM may become equal to or larger than the OT limit value.

If the in-cylinder injection ratio is decreased to zero when the amount of PM trapped in the particulate filter reaches the upper limit value, the quantity of PM discharged from the internal combustion engine further decreases. In consequence, the amount of PM trapped in the particulate filter is hard to reach the OT limit amount. Therefore, the probability that the filter regeneration processing is performed before the amount of PM trapped in the particulate filter reaches the OT limit amount is increased.

The fuel injection system of an internal combustion engine according to the present invention may further have knocking detection means that detects knocking of the internal combustion engine and retard means that retards ignition timing when knocking is detected by the knocking detection means. In this case, when the amount of retardation of ignition timing made by the retard means exceeds a predetermined amount, the control means makes the in-cylinder injection ratio larger than zero.

If the amount of PM trapped in the particulate filter becomes equal to or larger than the upper limit value, there is a possibility that the quantity of burned gas remaining in the cylinder may increase. An increase in the burned gas remaining in the cylinder leads to a rise in the temperature in the cylinder (which will be hereinafter referred to as the "in-cylinder temperature"). Moreover, if the in-cylinder injection ratio is decreased to zero, fall of the in-cylinder temperature by the evaporation latent heat of fuel injected through the first fuel injection valve cannot be expected. Therefore, if the in-cylinder injection ratio is decreased to zero when the amount of trapped PM is equal to or larger than the upper limit value, knocking may occur.

In the spark-ignition internal combustion engine, knocking is controlled by retarding the ignition timing when knocking is detected by the knocking detection means. However, when the amount of trapped PM is equal to or larger than the upper limit value and the in-cylinder injection ratio is set to zero, knocking is apt to occur, and there is a possibility that the amount of retardation of the ignition timing may become excessively large. An excessively large retardation of the ignition timing may lead to misfire and/or deterioration in combustion stability.

If the in-cylinder injection ratio is increased to a value larger than zero when the amount of retardation of the ignition timing exceeds a predetermined value (which may be equal to, for instance, an amount of retardation that may lead to misfire or deterioration in combustion stability minus a margin), the in-cylinder temperature decreases due to the evaporation latent heat of fuel injected through the first fuel injection valve. In consequence, the occurrence of knocking can be controlled. The method of increasing the in-cylinder injection ratio to a value larger than zero may be to increase the in-cylinder injection ratio to a ratio that is set in normal conditions (in which the amount of trapped PM is smaller than the threshold value) or to increase the in-cylinder injection ratio to a ratio that is set when a minimum quantity of fuel that can prevent the occurrence of knocking (which will be hereinafter referred to as the "knocking preventing injection quantity") is injected through the first fuel injection valve.

When the operation state of the internal combustion engine is in a range in which fuel is injected only through the second fuel injection valve, the control means may cause the first fuel injection valve to inject fuel by the knocking preventing injection quantity and to decrease the fuel injection quantity through the second fuel injection valve by the knocking preventing injection quantity.

In the fuel injection system for an internal combustion engine described in the foregoing, the processing of decreasing the in-cylinder injection ratio (including the processing of making the in-cylinder injection ratio equal to zero) may be continued until the filter regeneration processing is performed, preferably until the amount of PM trapped in the particulate filter becomes smaller than a criterion value that is smaller than the aforementioned threshold value. In other words, the control means may terminate the processing of decreasing the in-cylinder injection ratio at the time when the amount of PM trapped in the particulate filter becomes smaller than the criterion value that is smaller than the aforementioned threshold value.

The amount of PM trapped in the particulate filter correlates with the difference in the exhaust gas pressure upstream of the particulate filter and the exhaust gas pressure downstream of the particulate filter (which will be hereinafter referred to as the "upstream-downstream differential pressure"), the exhaust gas pressure upstream of the particulate filter (which will be hereinafter referred to as the "upstream exhaust gas pressure"), or the quantity of PM flowing out of the particulate filter (which will be hereinafter referred to as the "outflow PM quantity").

Therefore, the control means may use as a parameter representing the amount of trapped PM one of the upstream-downstream differential pressure, the upstream exhaust gas pressure, and the outflow PM quantity. In other words, the control means may use one of the upstream-downstream differential pressure, the upstream exhaust gas pressure, and the outflow PM quantity as a parameter to be compared with the aforementioned threshold value, the aforementioned upper limit value, or the aforementioned criterion value. The control means may use an amount of trapped PM (estimated value) calculated based on the operation state of the internal combustion engine (e.g. calculated using an integrated value of the fuel injection quantity or an integrate value of the intake air quantity as a parameter) as a parameter representing the amount of trapped PM.

Effects of the Invention

According to the present invention, in a spark-ignition internal combustion engine equipped with a first fuel injection valve for injecting fuel into a cylinder, a second fuel injection valve for injecting fuel into an intake passage, and a particulate filter provided in an exhaust passage, fuel injection can be performed in a mode suitable for the condition of the particulate filter.

THE BEST MODE FOR CARRYING OUT THE INVENTION

In the following, a specific embodiment of the present invention will be described with reference to the drawings. The dimensions, materials, shapes, relative arrangements, and other features of the components that will be described in connection with the embodiment are not intended to limit the technical scope of the present invention only to them, unless particularly stated.

Figure 1:
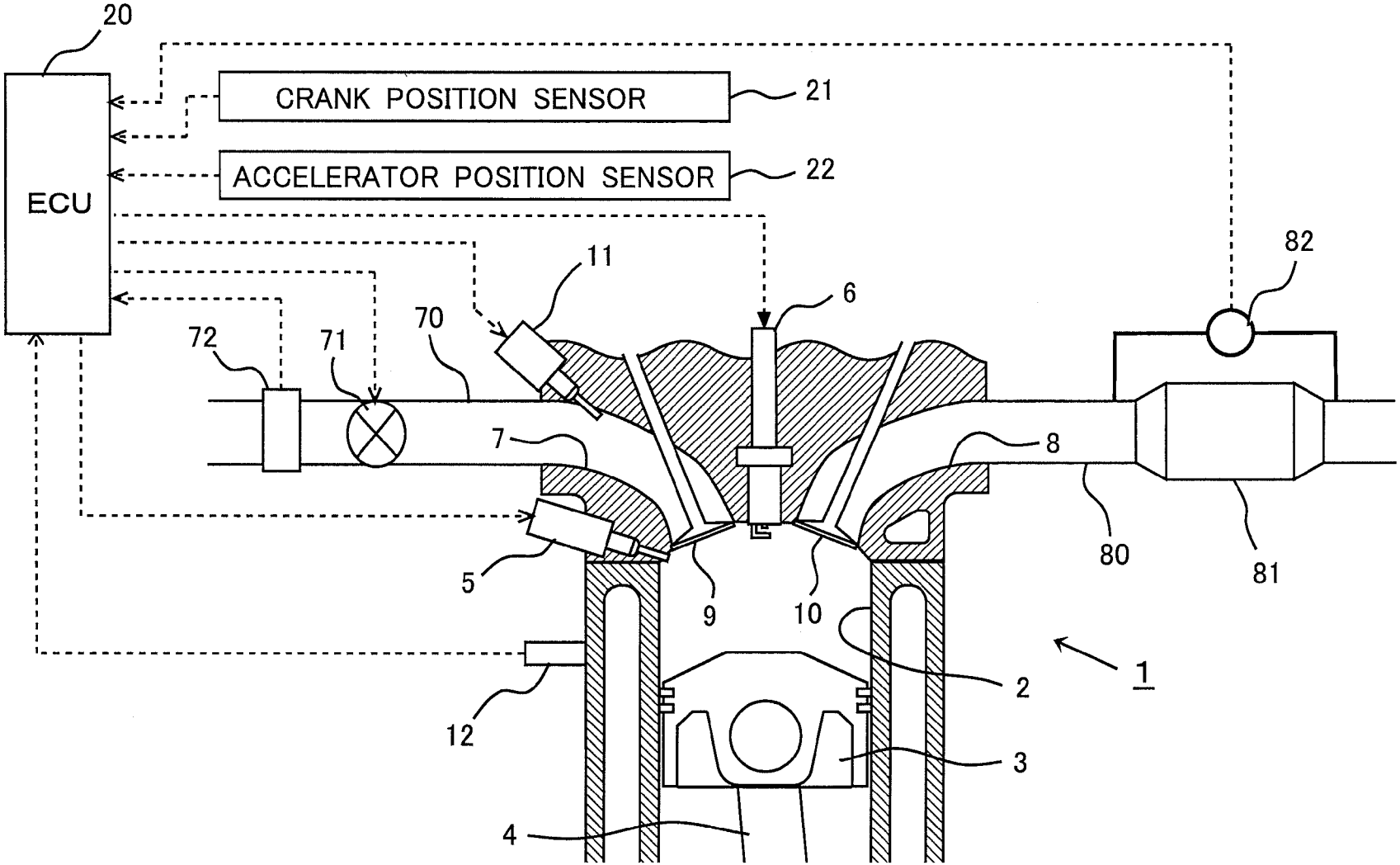
FIG. 1 is a diagram showing the basic construction of an internal combustion engine to which the present invention is applied.

FIG. 1 is a diagram showing the basic construction of an internal combustion engine to which the present invention is applied. The internal combustion engine 1 shown in FIG. 1 is a spark-ignition, four-stroke-cycle, internal combustion engine (gasoline engine) having a plurality of cylinders. FIG. 1 shows only one of the plurality of cylinders.

A piston 3 is fitted in each cylinder 2 of the internal combustion engine 1 in a slidable manner. The piston 3 is linked with an output shaft (crankshaft), which is not shown in the drawings, via a connecting rod 4. To each cylinder 2 are attached a first fuel injection valve 5 for injecting fuel into the cylinder and an ignition plug 6 for igniting air-fuel mixture in the cylinder.

The interior of the cylinder 2 is in communication with an intake port 7 and an exhaust port 8. The open end of the intake port 7 facing the interior of the cylinder 2 is opened/closed by an intake valve 9. The open end of the exhaust port 8 facing the interior of the cylinder 2 is opened/closed by the exhaust valve 10. The intake valve 9 and the exhaust valve 10 are driven to be opened/closed respectively by an intake cam and an exhaust cam, which are not shown in the drawings.

The intake port 7 is in communication with an intake passage 70. A throttle valve 71 is provided in the intake passage 70. An air flow meter 72 is provided in the intake passage 70 upstream of the throttle valve 71. A second fuel injection valve 11 for injecting fuel for the intake port 7 is provided in the intake passage 70 downstream of the throttle valve 71.

The exhaust port 8 is in communication with the exhaust passage 80. A particulate filter 81 for trapping particulate matter (PM) in the exhaust gas is provided in the exhaust passage 80. The particulate filter 81 is, for example, a wall-flow filter made of a porous base material. A purification apparatus having an exhaust gas purification catalyst (e.g. three-way catalyst, $NO_x$ storage reduction catalyst, or $NO_x$ selective reduction catalyst) may be provided in the exhaust passage upstream of the particulate filter 81 or in the exhaust passage 80 downstream of the particulate filter 81.

An ECU 20 is annexed to the internal combustion engine 1 having the above-described structure. The ECU 20 is an electronic control unit composed of a CPU, a ROM, a RAM, and a backup RAM etc. The ECU 20 is adapted to receive input measurement signals from various sensors including a knock sensor 12, a crank position sensor 21, an accelerator position sensor 22, and a differential pressure sensor 82 as well as the aforementioned air flow meter 72.

The air flow meter 72 outputs an electronic signal correlating with the quantity (or mass) of the intake air flowing in the intake passage 70. The knock sensor 12 is attached to the cylinder block of the internal combustion engine 1 to output an electrical signal correlating with the magnitude of vibration of the cylinder block. The knock sensor 12 corresponds to the knocking detection means according to the present invention. The crank position sensor 21 outputs a signal correlating with the rotational position of the crankshaft. The accelerator position sensor 22 outputs an electronic signal correlating with the amount of operation of the accelerator pedal not shown (or accelerator opening degree). The differential pressure sensor 82 outputs an electrical signal correlating with the difference between the exhaust gas pressure upstream of the particulate filter 81 and the exhaust gas pressure downstream of the particulate filter 81 (upstream-downstream differential pressure).

The ECU 20 is electrically connected with various devices including the first fuel injection valve 5, the ignition plug 6, the second fuel injection valve 11, and the throttle valve 71 and controls these devices on the basis of signals output from the aforementioned sensors. For instance, the ECU 20 controls the injection ratio, which is the ratio of the fuel injection quantity through the first fuel injection valve 5 and the fuel injection quantity through the second fuel injection valve 11, according to the operation state of the internal combustion engine 1 determined by signals output from the crank position sensor 21, the accelerator position sensor 22, and the air flow meter 72. In the following, a method of controlling the fuel injection ratio in this embodiment will be described.

Firstly, the ECU 20 computes a base fuel injection ratio using the operation state (in terms of the engine speed, the accelerator opening degree, and the intake air quantity etc.) of the internal combustion engine 1 as parameters. The "base fuel injection ratio" mentioned here includes a base value of the ratio (in-cylinder injection ratio) of the quantity of fuel injected through the first fuel injection valve 5 to the total fuel injection quantity (i.e. the sum total of the quantity of fuel injected through the first fuel injection valve 5 and the quantity of fuel injected through the second injection valve 11) and a base value of the ratio (port injection ratio) of the quantity of fuel injected through the second fuel injection valve 11 to the total fuel injection quantity.

The relationship between the operation state of the internal combustion engine 1 and the base fuel injection ratio may be determined in advance by an adaptation process based on, for example, experiments and stored as a map or a function expression in the ROM of the ECU 20.

Then, the ECU 20 determines whether or not the amount of PM trapped in the particulate filter 81 (the trapped PM amount) is equal to or larger than a threshold value. The trapped PM amount may be estimated by computation using the history of operation of the internal combustion engine 1 (such as an integrated value of the fuel injection quantity and/or an integrated value of the intake air quantity) as a parameter(s). Since the trapped PM amount correlates with the upstream-downstream differential pressure across the particulate filter 81, a signal output from the differential pressure sensor 82 may be used as a value representing the trapped PM amount. Furthermore, since the trapped PM amount also correlates with the quantity of PM flowing out of the particulate filter 81 (flowing out PM quantity), a signal output from a PM sensor (not shown) provided in the exhaust passage 80 downstream of the particulate filter 81 may be used as a value representing the trapped PM amount. Moreover, since the trapped PM amount also correlates with the exhaust gas pressure upstream of the particulate filter 81, a signal output from a pressure sensor (not shown) provided in the exhaust passage 80 upstream of the particulate filter 81 may be used as a value representing the trapped PM amount. In this embodiment, a case in which the signal output from the differential pressure sensor 82 is used as a value representing the trapped PM amount will be described.

The aforementioned threshold value is, for example, a value equal to a trapped PM amount that is considered to require processing for removing the PM trapped in the particulate filter 81 by oxidation (filter regeneration processing) or a value equal to this trapped PM amount minus a margin.

When the trapped PM amount is smaller than the threshold value, the ECU 20 computes a fuel injection quantity (or fuel injection time) for each of the first fuel injection valve 5 and the second fuel injection valve 11 in accordance with the aforementioned base fuel injection ratio. For example, the ECU 20 computes a fuel injection quantity for the first fuel injection valve 5 by multiplying the total fuel injection quantity determined according to the operation state of the internal combustion engine 1 by the base value of the in-cylinder injection ratio. The ECU 20 also computes a fuel injection quantity for the second fuel injection valve 11 by multiplying the total fuel injection quantity by the base value of the port injection quantity.

On the other hand, when the trapped PM amount is equal to or larger than the threshold value, the ECU 20 corrects the aforementioned base fuel injection ratio in such a way as to decrease the in-cylinder injection ratio. For example, the ECU 20 multiplies the base value of the in-cylinder injection ratio by a correction coefficient (which will be hereinafter referred to as the "first correction coefficient) equal to or smaller than 1 and multiplies the base value of the port injection ratio by a correction coefficient (which will be hereinafter referred to as the "second correction coefficient") equal to or larger than 1. The first correction coefficient and the second correction coefficient are to be determined in such a way that the total fuel injection quantity after the correction becomes equal to the total fuel injection quantity before the correction. The first correction coefficient and the second correction coefficient may be either fixed values or variable values increased or decreased according to the trapped PM amount. In the case where the first correction coefficient and the second correction coefficient are variable values, the first correction coefficient is made smaller and the second correction coefficient is made larger when the trapped PM amount is large than when it is small.

Figure 2:
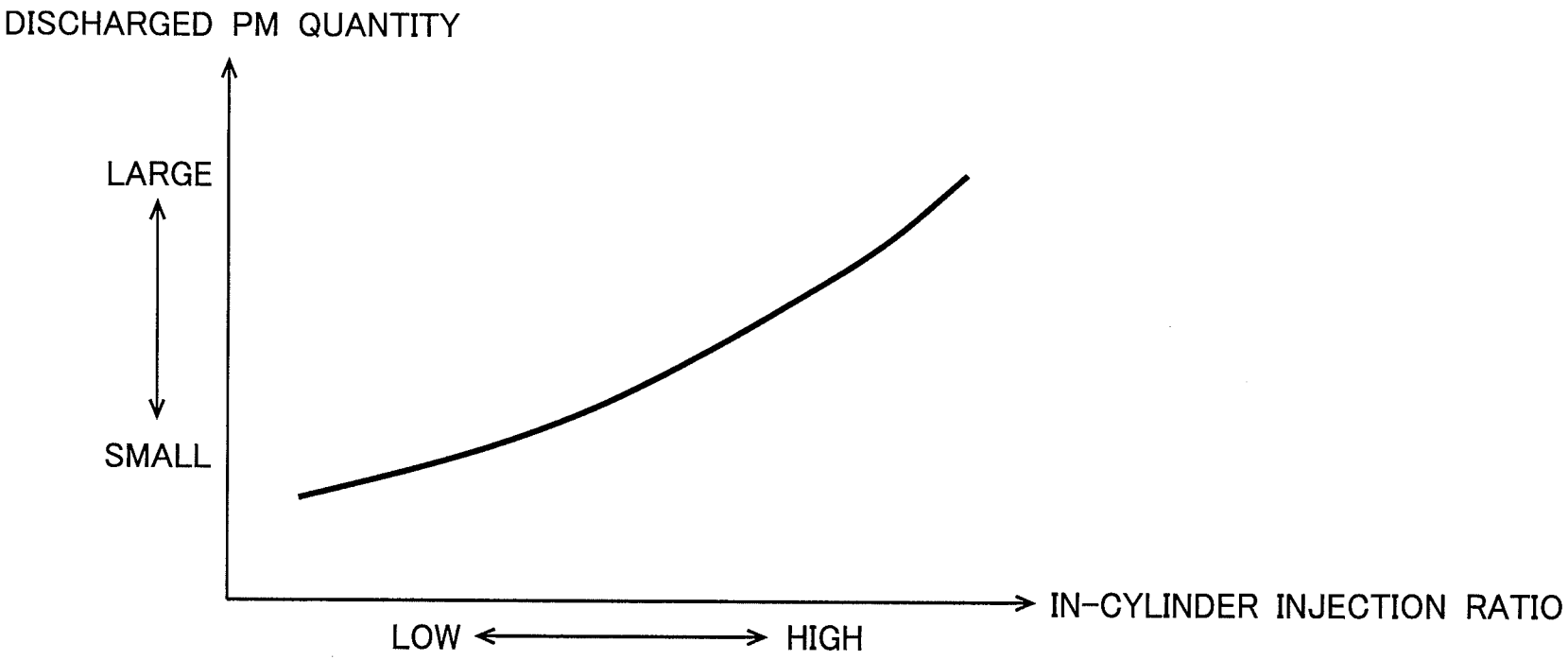
FIG. 2 is a graph showing a relationship between the in-cylinder injection ratio and the discharged PM quantity.

With correction of the in-cylinder injection ratio and the port injection ratio performed by the above-described manner, the quantity of PM discharged from the internal combustion engine 1 decreases when the trapped PM amount is equal to or larger than the threshold value. The quantity of PM discharged from the internal combustion engine 1 (discharged PM quantity) tends to be smaller when the in-cylinder injection ratio is low than when it is high, as shown in FIG. 2. Therefore, if the in-cylinder injection ratio is decreased and the port injection ratio is increased when the trapped PM amount is equal to or larger than the threshold value, the quantity of PM discharged from the internal combustion engine becomes smaller.

A decrease in the quantity of PM discharged from the internal combustion engine 1 leads to a decrease in the quantity of PM trapped by the particulate filter 81 per unit time. In other words, as the quantity of PM discharged from the internal combustion engine 1 decreases, the increase in the trapped PM amount per unit time (i.e. the increase rate of the trapped PM amount) decreases.

When the filter regeneration processing is performed, it is necessary to expose the particulate filter 81 to a high temperature atmosphere containing excessive oxygen. Therefore, the operation range in which the filter regeneration processing can be performed is limited to a range in which the internal combustion engine 1 operates at a lean air-fuel ratio or a range in which fuel-cut operation is performed. Therefore, it is considered that there may be cases where an operation state that is not suitable for the filter regeneration processing continues after the trapped PM amount reaches the threshold value. In such cases, there is a possibility that the trapped PM amount in the particulate filter 81 may become excessively large, so that the back pressure acting on the internal combustion engine 1 may become excessively high. A high back pressure acting on the internal combustion engine 1 may lead to a decrease in the engine power due to a decrease in the air intake efficiency and/or exhaust efficiency or a problem such as an increase in the fuel consumption necessitated for the purpose of preventing a decrease in the engine power.

If the quantity of PM discharged from the internal combustion engine 1 is decreased when the trapped PM amount is equal to or larger than the threshold value, excessive increase in the trapped PM amount can be prevented even if an operation state that is not suitable for the filter regeneration processing continues. In consequence, the decrease in the engine power and the increase in the fuel consumption can be minimized.

Even in the case where processing of decreasing the in-cylinder injection ratio is performed in the above-described manner, there is a possibility that the trapped PM amount may reach or exceed an OT limit amount, if an operation state not suitable for the filter regeneration processing continues for a long period of time. The "OT limit amount" mentioned above is a trapped PM amount that is considered to cause excessive temperature rise of the particulate filter 81 when the filter regeneration processing is performed. The OT limit amount is larger than the aforementioned threshold value.

In view of the above, the ECU 20 is adapted to correct the base injection ratio in such a way as to make the in-cylinder injection ratio equal to zero when the amount of PM trapped in the particulate filter 81 reaches an upper limit value. The "upper limit value" mentioned above is a value of the trapped PM amount equal to the OT limit amount minus a margin. This upper limit value is larger than the aforementioned threshold value.

When the in-cylinder injection ratio is set to zero, the quantity of fuel injected through the first fuel injection valve 5 becomes zero (namely, fuel injection through the first fuel injection valve 5 is suspended), and the quantity of fuel injected through the second fuel injection valve 11 becomes equal to the total fuel injection quantity. As a result, the quantity of PM discharged from the internal combustion engine 1 further decreases. Therefore, even if an operation state not suitable for the filter regeneration processing continues for a long period of time after the trapped PM amount reaches the threshold value, the trapped PM amount is hard to reach the OT limit amount. In other words, it is possible to prolong the time taken for the OT limit amount to be reached after the trapped PM amount reaches the threshold value. If the time taken for the OT limit amount to be reached after the trapped PM amount reaches the threshold value is prolonged, the probability that the filter regeneration processing is performed before the trapped PM amount reaches the OT limit amount can be increased.

If the trapped PM amount increases exceeding the aforementioned upper limit value, the exhaust efficiency of the internal combustion engine 1 decreases, leading to an increase in the quantity of burned gas remaining in the cylinder 2. Since the temperature of the burned gas is higher than the temperature of the intake air, the in-cylinder temperature is higher when the quantity of burned gas remaining in the cylinder 2 is larger. When the in-cylinder injection ratio is set to zero, fall of the in-cylinder temperature by the evaporation latent heat of fuel injected through the first fuel injection valve 5 cannot be expected. Therefore, if the in-cylinder injection ratio is made equal to zero at a time when the trapped PM amount is equal to or larger than the upper limit value, there is a possibility that knocking may occur.

As a countermeasure to this, when the knock sensor 12 detects the occurrence of knocking (namely, when the magnitude of the vibration measured by the knock sensor 12 is larger than a knocking criterion value), the ECU 20 retards the operation timing (ignition timing) of the ignition plug 6. However, when the trapped PM amount is equal to or larger than the upper limit value and the in-cylinder injection ratio is set to zero, knocking is apt to occur, and there is a possibility that the amount of retardation of the ignition timing may become excessively large. An excessively large retardation of the ignition timing may lead to misfire or deterioration in combustion stability.

In view of this, if the amount of retardation of ignition timing exceeds a predetermined amount when the trapped PM amount is equal to or larger than the upper limit value and the in-cylinder injection ratio is set to zero, the ECU 20 increases the in-cylinder injection ratio to value larger than zero. In other words, if the amount of retardation of ignition timing exceeds the predetermined amount when the trapped PM amount is equal to or larger than the upper limit value and the in-cylinder injection ratio is set to zero, the ECU 20 causes the first fuel injection valve 5 to inject fuel. The "predetermined amount" mentioned above is, for example, an amount of retardation that may lead to misfire or deterioration in combustion stability minus a margin.

The way of increasing the in-cylinder injection ratio to a value larger than zero may be to change the in-cylinder injection ratio back to the base injection ratio before correction. However, when the operation state of the internal combustion engine 1 is in a operation range in which fuel is injected only through the second fuel injection valve 11, the ECU 20 may cause the first fuel injection valve 5 to inject fuel by the knocking preventing injection quantity and decrease the fuel injection quantity through the second fuel injection valve 11 by the knocking preventing injection quantity.

If the in-cylinder injection ratio is increased to a value larger than zero when the amount of retardation of ignition timing exceeds the predetermined amount, the in-cylinder temperature is lowered by the evaporation latent heat of fuel injected through the first fuel injection valve 5. In consequence, the occurrence of knocking can be prevented, and misfire and deterioration in combustion stability due to excessive retardation of ignition timing can also be prevented.

The above-described method of controlling the fuel injection ratio enables fuel injection to be carried out in a manner suitable for the condition of the particular filter 81 (i.e. the trapped PM amount) and can prevent misfire of the internal combustion engine 1 and deterioration in combustion stability.

Figure 3:
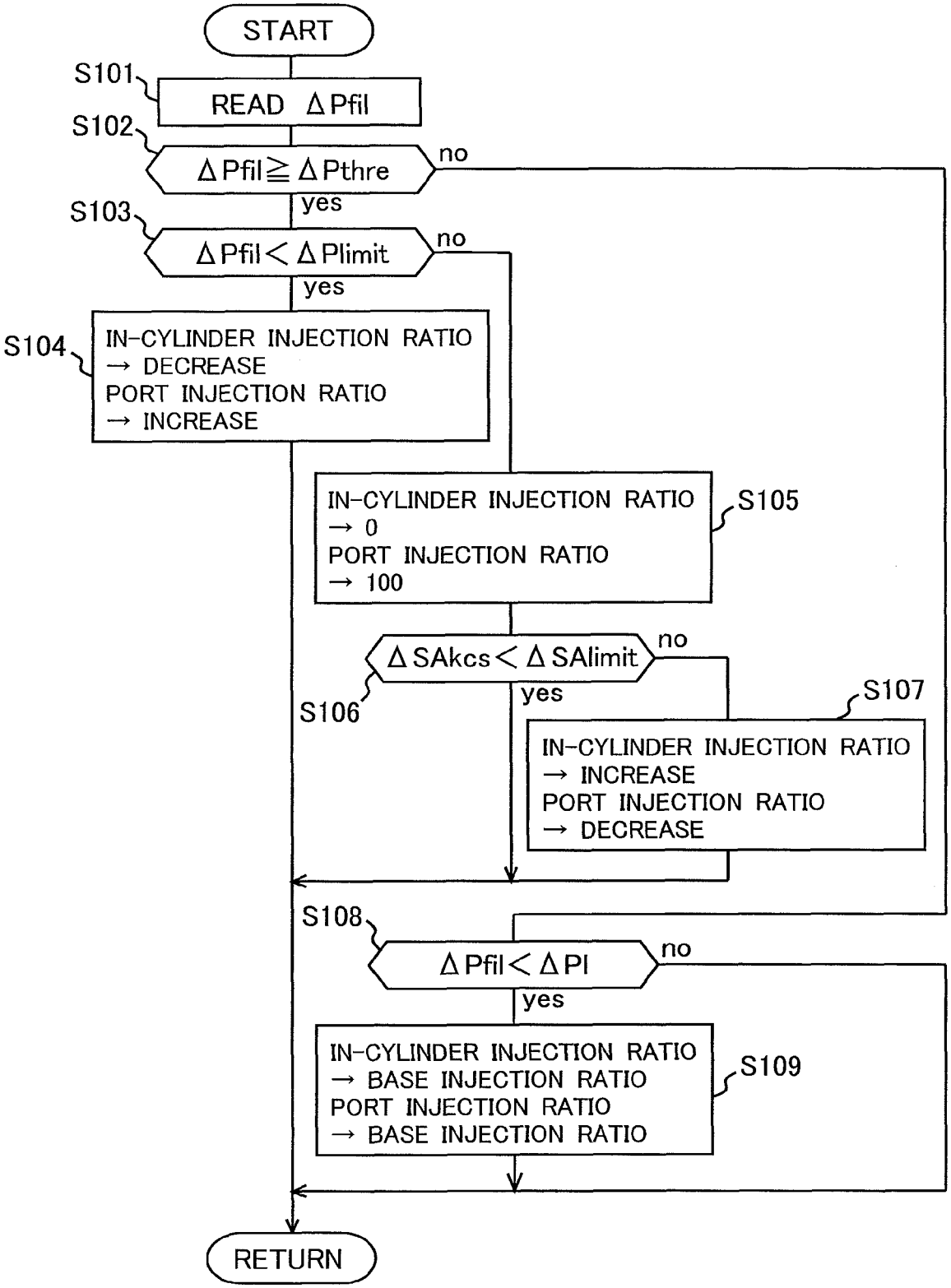
FIG. 3 is a flow chart of a routine executed to determine the injection ratio in an embodiment.

Now, a process of controlling the fuel injection ratio in this embodiment will be described with reference to FIG. 3. FIG. 3 is a flow chart of a processing routine executed by the ECU 20 to determine the fuel injection ratio. This routine is stored in advance in the ROM of the ECU 20 and executed by the ECU 20 periodically.

In the processing routine shown in FIG. 3, first in step S101, the ECU 20 reads an output signal of the differential pressure sensor 82 (upstream-downstream differential pressure) ΔPfil. Then, the ECU 20 proceeds to step S102, where it determines whether or not the upstream-downstream differential pressure ΔPfil is equal to or larger than a threshold value ΔPthre. If the determination made in the above step S102 is affirmative (ΔPfil≥ΔPthre), the ECU 20 proceeds to step S103.

In step S103, the ECU 20 determines whether or not the upstream-downstream differential pressure ΔPfil is equal to or smaller than an upper limit value ΔPlimit. If the determination made in the above step S103 is affirmative (ΔPfil<ΔPlimit), the ECU 20 proceeds to step S104.

In step S104, the ECU 20 corrects the base fuel injection ratio in such a way as to decrease the in-cylinder injection ratio and to increase the port injection ratio. Then, the quantity of PM discharged from the internal combustion engine 1 decreases, and the increase in the trapped PM amount per unit time decreases consequently. In consequence, an excessive increase in the trapped PM amount can be avoided even if an operation state that is not suitable for the filter regeneration processing continues after the trapped PM amount (upstream-downstream differential pressure ΔPfil) reaches the threshold value (ΔPthre). After executing the process of the above step S104, the ECU 20 once terminates this routine.

If the determination made in the above step S103 is negative (ΔPfil≥ΔPlimit), the ECU 20 proceeds to step S105. In step S105, the ECU 20 corrects the base injection ratio in such a way as to make the in-cylinder injection ratio equal to zero. In other words, the ECU 20 corrects the base injection ratio in such a way as to make the port injection ratio equal to 100%. Then, the quantity of PM discharged from the internal combustion engine 1 further decreases. Therefore, the trapped PM amount is hard to reach the OT limit amount, even if an operation state not suitable for the filter regeneration processing continues after the trapped PM amount (upstream-downstream differential pressure ΔPfil) becomes equal to or larger than the upper limit value (ΔPlimit).

After executing the process of the above step S105, the ECU 20 proceeds to step S106, where it determines whether or not the amount of retardation of ignition timing made with the occurrence of knocking (knock retardation amount)

ΔSAkcs is smaller than a predetermined amount ΔSAlimit. If the determination made in the above step S106 is affirmative (ΔSAkcs<ΔSAlimit), the ECU 20 once terminates this routine. On the other hand, if the determination made in the above step S106 is negative (×SAkcs≥ΔSAlimit), the ECU 20 proceeds to step S107.

In step S107, the ECU 20 increases the in-cylinder injection ratio to a value larger than zero and decreases the port injection ratio by an amount equal to the increase in the in-cylinder injection ratio. Then, the in-cylinder temperature falls due to the evaporation latent heat of fuel injected through the first fuel injection valve 5. Consequently, it is possible to prevent knocking from occurring while keeping the knock retardation amount ΔSAkcs smaller than the predetermined amount ΔSAlimit. After completion of the process of the above step S107, the ECU 20 once terminates this routine.

If the determination made in the above step S102 is negative (ΔPfil<ΔPthre), the ECU 20 proceeds to step S108. In step S108, the ECU 20 determines whether or not the upstream-downstream differential pressure ΔPfil is smaller than a criterion value ΔP1. In other words, the ECU 20 determines whether or not the trapped PM amount has decreased with the execution of the filter regeneration processing. The "criterion value ΔP1" mentioned above is a trapped PM amount sufficiently smaller than the aforementioned threshold value ΔPthre.

If the determination made in the above step S108 is negative (ΔPfil≥ΔP1), the ECU 20 once terminates this routine. On the other hand, if the determination made in the above step S108 is affirmative (ΔPfil<ΔP1), the ECU 20 proceeds to step S109, where it changes the in-cylinder injection ratio and the port injection ratio back to their base injection ratios. After completion of the process of step S109, the ECU 20 once terminates this routine.

As described above, the control means according to the present invention is implemented by executing the processing routine shown in FIG. 3 by the ECU 20. As a result, it is possible to perform fuel injection in a manner suitable for the condition of the particulate filter 81 (or the trapped PM amount) and the operation state (knocking retardation amount) of the internal combustion engine 1. In consequence, it is possible to control excessive increase in the trapped PM amount while preventing excessive increase in the knocking retardation amount.

While a case in which the knock sensor 12 is used as the knocking detection means according to the present invention has been described in the embodiment, the knocking detection means is not limited to this. For example, the ECU 20 may detect abnormal combustion (knocking) on the basis of a combustion pressure waveform obtained by an in-cylinder pressure sensor. Alternatively, the ECU 20 may detect abnormal combustion (knocking) on the basis of an ion current measured by an ion current measurement device attached to the ignition plug 6.

DESCRIPTION OF THE REFERENCE NUMERALS AND SYMBOLS

1: internal combustion engine
2: cylinder
3: piston
4: connecting rod
5: first fuel injection valve
6: ignition plug
7: intake port
8: exhaust port
9: intake valve
10: exhaust valve
11: second fuel injection valve
12: knock sensor
20: ECU
21: crank position sensor
22: accelerator position sensor
70: intake passage
71: throttle valve
72: air flow meter
80: exhaust passage
81: particulate filter
82: differential pressure sensor

The invention claimed is:

1. A fuel injection system of an internal combustion engine, comprising:

a first fuel injection valve that injects fuel into a cylinder;

a second fuel injection valve that injects fuel into an intake passage;

a particulate filter provided in an exhaust passage to trap particulate matter contained in exhaust gas;

control unit that makes an in-cylinder injection ratio smaller when the quantity of particulate matter trapped in the particulate filter is equal to or larger than a threshold value than when it is smaller than the threshold value and makes the in-cylinder injection ratio equal to zero when the quantity of particulate matter trapped in the particulate filter is equal to or larger than an upper limit value that is larger than the threshold value, the in-cylinder injection ratio being the ratio of the quantity of fuel injected through the first fuel injection valve to the total quantity of fuel injected through the first fuel injection valve and the second fuel injection valve.

2. A fuel injection system for an internal combustion engine according to claim 1, further comprising:

knocking detection unit that detects knocking of the internal combustion engine; and retard unit that retards ignition timing when the knocking detection unit detects knocking, wherein when the amount of retardation of ignition timing made by the retard unit exceeds a predetermined amount, the control unit makes the in-cylinder injection ratio larger than zero.

3. A fuel injection system of an internal combustion engine according to claim 1, wherein the control unit terminates a processing for reducing the in-cylinder injection ratio, when the quantity of particulate matter trapped in the particulate filter becomes smaller than a criterion value that is smaller than said threshold value.

4. A fuel injection system of an internal combustion engine according to claim 1, the control unit uses, as a parameter representing the quantity of particulate matter trapped in the particulate filter, one of an upstream-downstream differential pressure across the particulate filter, an exhaust gas pressure upstream of the particulate filter, a quantity of particulate matter flowing out of the particulate filter, and an estimated value calculated from operation history of the internal combustion engine.

5. A fuel injection system of an internal combustion engine according to claim 2, wherein the control unit terminates a processing for reducing the in-cylinder injection ratio, when the quantity of particulate matter trapped in the particulate filter becomes smaller than a criterion value that is smaller than said threshold value.

6. A fuel injection system of an internal combustion engine according to claim 2, the control unit uses, as a parameter representing the quantity of particulate matter trapped in the particulate filter, one of an upstream-downstream differential pressure across the particulate filter, an exhaust gas pressure upstream of the particulate filter, a quantity of particulate matter flowing out of the particulate filter, and an estimated value calculated from operation history of the internal combustion engine.

7. A fuel injection system of an internal combustion engine according to claim 3, the control unit uses, as a parameter representing the quantity of particulate matter trapped in the particulate filter, one of an upstream-downstream differential pressure across the particulate filter, an exhaust gas pressure upstream of the particulate filter, a quantity of particulate matter flowing out of the particulate filter, and an estimated value calculated from operation history of the internal combustion engine.

8. A fuel injection system of an internal combustion engine according to claim 5, the control unit uses, as a parameter representing the quantity of particulate matter trapped in the particulate filter, one of an upstream-downstream differential pressure across the particulate filter, an exhaust gas pressure upstream of the particulate filter, a quantity of particulate matter flowing out of the particulate filter, and an estimated value calculated from operation history of the internal combustion engine.

* * * * *